US010421126B2

(12) United States Patent
Lyu et al.

(10) Patent No.: US 10,421,126 B2
(45) Date of Patent: Sep. 24, 2019

(54) METHOD AND APPARATUS FOR PRODUCING IRON POWDER

(71) Applicant: Hyundai Motor Company, Seoul (KR)

(72) Inventors: Hyun Gon Lyu, Hwaseong-si (KR); Joon Chul Yun, Incheon (KR)

(73) Assignee: Hyundai Motor Company, Seoul (KR)

( * ) Notice: Subject to any disclaimer, the term of this patent is extended or adjusted under 35 U.S.C. 154(b) by 274 days.

(21) Appl. No.: 15/373,059

(22) Filed: Dec. 8, 2016

(65) Prior Publication Data

US 2018/0001386 A1 Jan. 4, 2018

(30) Foreign Application Priority Data

Jul. 4, 2016 (KR) ..... 10-2016-0084107

(51) Int. Cl.
*B22F 9/08* (2006.01)

(52) U.S. Cl.
CPC ..... *B22F 9/082* (2013.01); *B22F 2009/088* (2013.01); *B22F 2009/0828* (2013.01); *B22F 2009/0848* (2013.01); *B22F 2009/0872* (2013.01); *B22F 2009/0888* (2013.01); *B22F 2009/0892* (2013.01)

(58) Field of Classification Search
None
See application file for complete search history.

(56) References Cited

U.S. PATENT DOCUMENTS 3,951,577 A * 4/1976 Okayama ..... B22F 9/082 425/7
5,402,992 A * 4/1995 Saxena ..... B22F 9/08 164/437
6,561,440 B1 * 5/2003 Hofherr ..... B05B 1/3447 239/472

FOREIGN PATENT DOCUMENTS

| | | | |
|---|---|---|---|
| JP | 61-266505 | A | 11/1986 |
| JP | 4-66608 | A | 3/1992 |
| JP | 4-83813 | A | 3/1992 |
| JP | 4-99105 | A | 3/1992 |
| JP | 4-168209 | A | 6/1992 |
| KR | 10-2012-0100632 | A | 9/2012 |

OTHER PUBLICATIONS

Translation of JP 04-066608 (published Mar. 3, 1993) from J-Plat Pat.*
Translation of JP 04-168209 (published Jun. 16, 1992) from J-Plat Pat.*

* cited by examiner

*Primary Examiner* — George Wyszomierski
(74) *Attorney, Agent, or Firm* — Morgan, Lewis & Bockius LLP

(57) ABSTRACT

A method of producing iron powder by a water atomization process may include preparing a molten metal in a tundish, discharging the molten metal in a free-falling manner by opening an orifice formed on a bottom of the tundish, and producing iron powder by spraying water onto the free-falling molten metal using a pair of water spraying nozzles, an angle formed by the water spraying nozzles being at least 45°.

2 Claims, 5 Drawing Sheets

METHOD AND APPARATUS FOR PRODUCING IRON POWDER

CROSS REFERENCE TO RELATED APPLICATION

The present application claims priority to Korean Patent Application No. 10-2016-0084107, filed Jul. 4, 2016, the entire contents of which is incorporated herein for all purposes by this reference.

BACKGROUND OF THE INVENTION

Field of the Invention

The present invention relates to a method and apparatus for producing iron powder, and, more particularly, to a method and apparatus for producing iron powder, capable of increasing a recovery rate of iron powder when the iron powder is produced by a water atomization process of spraying water along a linear region of flow of molten metal falling free.

Description of Related Art

In general, powder metallurgy is a method of pressing and forming metal powder in a mold, and then sintering the same to manufacture sintered parts. This method is mainly used to manufacture vehicle parts such as gears required for high precision since the method can be used to manufacture machine parts which have complicated shapes and require high precision.

Among various types of metal powder, iron (Fe) powder has a particle size of about 50 to 150 μm, and is not used alone. Typically, mixed powder is used made by adding an alloying element(s), such as carbon (C), nickel (Ni), copper (Cu), or molybdenum (Mo), to iron (Fe) powder according to various purposes for improvement in strength.

The iron powder used to produce mixed powder is typically produced by a water atomization process. The water atomization process is a method of spraying water on molten metal, which vertically falls, using a high-pressure pump, thus to produce metal powder using its impact force and cooling rate.

This water atomization process is mainly used to pulverize metal, such as iron (Fe) or copper (Cu), which has a relatively high melting point and does not oxidize quickly.

In particular, iron powder used for powder metallurgy is commonly produced by a water atomization process since it has to be in the form of irregular particles for compressibility and mechanical properties of sintered bodies.

FIG. 1 is a view for explaining a conventional method of producing metal powder by a water atomization process.

As illustrated in FIG. 1, in the conventional method of producing metal powder by a water atomization process, metal powder is produced in such a manner that a molten metal 3 accommodated in a tundish 1 is discharged downward through an orifice 5 formed in the lower portion of the tundish 1, in which case water is sprayed onto the free-falling molten metal 3 in symmetrical directions using nozzles 9 which are installed to face each other.

In more detail, the water sprayed from each of the nozzles 9 has a typical pressure of 100 to 200 bar. The streams of sprayed water 7 transform the molten metal 3 into droplet form by colliding with each other at a specific point of the flow of the molten metal 3, and then solidify it, with the result that metal powder is finally produced.

Most of physical properties of the iron powder produced by the water atomization process vary according to variables in the water atomization process, e.g. the pressure and angle of water sprayed from each nozzle 9.

In order to increase the recovery rate of metal powder in the water atomization process, the metal powder is typically produced by increasing an atomization angle formed by the streams of water sprayed from the nozzles 9.

In this case, powder having a particle size of 180 μm or less is sieved and used as the product of iron powder. Powder having a particle size of 180 μm or more is sieved and used as the material of molten metal, or is used as dummy powder for the purpose of cleaning in other processes, or is used in small quantity only when manufacturing parts which require large particle-sized powder according to special purposes.

Accordingly, the recovery rate in the production of iron powder means a fraction of powder having a particle size of 180 μm or less.

However, when the atomization angle is increased to increase the recovery rate, the traveling distance of water is short and the impact force thereof is excessively strong. Hence, a water splash phenomenon, in which sprayed water is splashed upward vertically, occurs.

FIG. 2 is a schematic view for illustrating that build-up of molten metal occurs due to a water splash phenomenon in the related art.

As illustrated in FIG. 2, when a water splash phenomenon occurs, a build-up phenomenon, in which particles of molten metal adhere and grow around nozzles 9, occurs. The occurrence of build-up decreases a recovery rate or degrades productivity due to discontinuity of processes. Therefore, if neglected, equipment itself may be damaged.

Thus, the related art has attempted to reduce the build-up of particles of a molten metal 3 due to water splash, by spraying water from each nozzle 9 at an acute angle of less than 40° and increasing a vertical distance to the point at which water collides with the molten metal 3. However, there is a problem in that the smaller the injection angle formed by the streams of water, the worse the recovery rate of metal powder.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a method and apparatus for producing iron powder, capable of increasing a recovery rate of iron powder while preventing a water splash phenomenon by adjusting an angle of water sprayed onto a molten metal falling free.

According to various aspects of the present invention, a method of producing iron powder by a water atomization process may include preparing a molten metal in a tundish, discharging the molten metal in a free-falling manner by opening an orifice formed on a bottom of the tundish, and producing iron powder by spraying water onto the free-falling molten metal using a pair of water injection nozzles, an angle formed by the water spraying nozzles being at least 45°.

The method may further include prior to the discharging the molten metal, adjusting a distance between the water spraying nozzles by adjusting positions of the water spraying nozzles so an atomization angle formed by streams of water sprayed from the water spraying nozzles ranges from 45 to 50°.

In the adjusting the distance between the water spraying nozzles, the atomization angle may be adjusted by adjusting the distance between the water spraying nozzles in a state in which a collision point of water sprayed from each of the water spraying nozzles with the falling molten metal is fixed.

In the producing the iron powder, an atomization pressure of the water sprayed from each of the water spraying nozzles may be adjusted depending on the distance between the water spraying nozzles.

In the producing the iron powder, the atomization pressure of each of the water spraying nozzles may be determined and controlled according to a following Equation:

$$\frac{\log P}{\log P_0} = \frac{D}{D_0},$$

wherein P is atomization pressure (bar), $P_0$ is initial atomization pressure (bar), D is spraying distance (mm), and $D_0$ is initial spraying distance (mm).

According to various aspects of the present invention, an apparatus for producing iron powder by a water atomization process, may include a pair of injectors disposed in a lower portion of a tundish to face each other with a free-falling molten metal interposed therebetween, for spraying water onto the molten metal, in which the nozzles may be disposed such that a distance therebetween is adjustable.

Each of the nozzles may include a fixed body including a thread formed on an outer peripheral surface of the fixed body, a first side of the fixed body being fixed to the lower portion of the tundish, a water spraying nozzle including a thread formed on an inner peripheral surface of the water spraying nozzle, the thread engaging with the thread formed on the outer peripheral surface of the fixed body, the water spraying nozzle being disposed on the second side of the fixed body and spraying water onto the molten metal discharged from the tundish to produce iron powder, and a spring disposed around the outer peripheral surface of the fixed body to fix a position of the water spraying nozzle, the spring providing an elastic force to the water spraying nozzle.

An atomization angle formed by streams of water sprayed from the pair of water spraying nozzles ranges from 45 to 50°.

An atomization pressure of the water spraying nozzle may be determined and controlled according to the following Equation:

$$\frac{\log P}{\log P_0} = \frac{D}{D_0},$$

wherein P is atomization pressure (bar), $P_0$ is initial atomization pressure (bar), D is spraying distance (mm), and $D_0$ is initial spraying distance (mm).

Each of the nozzles may include a spacer having a variable length, a first side of the spacer being fixed to the lower portion of the tundish, a water spraying nozzle disposed on a second side of the spacer to spray water onto the molten metal discharged from the tundish for production of iron powder, and a length adjustment member disposed in the spacer to adjust the length of the spacer.

As apparent from the above description, it is possible to increase the recovery rate of iron powder while preventing a water splash phenomenon by adjusting the angle and pressure of water sprayed onto the molten metal. Consequently, it is possible to prevent equipment from being damaged and to easily perform maintenance.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An apparatus for producing iron powder according to various embodiments of the present invention is an apparatus for producing iron powder by a water atomization process, and includes a pair of nozzles 10 which are disposed to face each other with a molten metal 3, falling downward from a tundish 1, interposed therebetween so as to spray water onto a linear region of the flow of the molten metal 3 falling downward from the tundish 1.

In this case, the nozzles 10 are disposed such that the distance therebetween varies with the flow of the molten metal 3 falling free interposed therebetween, and thus form an atomization angle θ of 45 to 50°. Consequently, it is possible to reduce occurrence of water splash and increase a recovery rate of iron powder.

Figure 1:
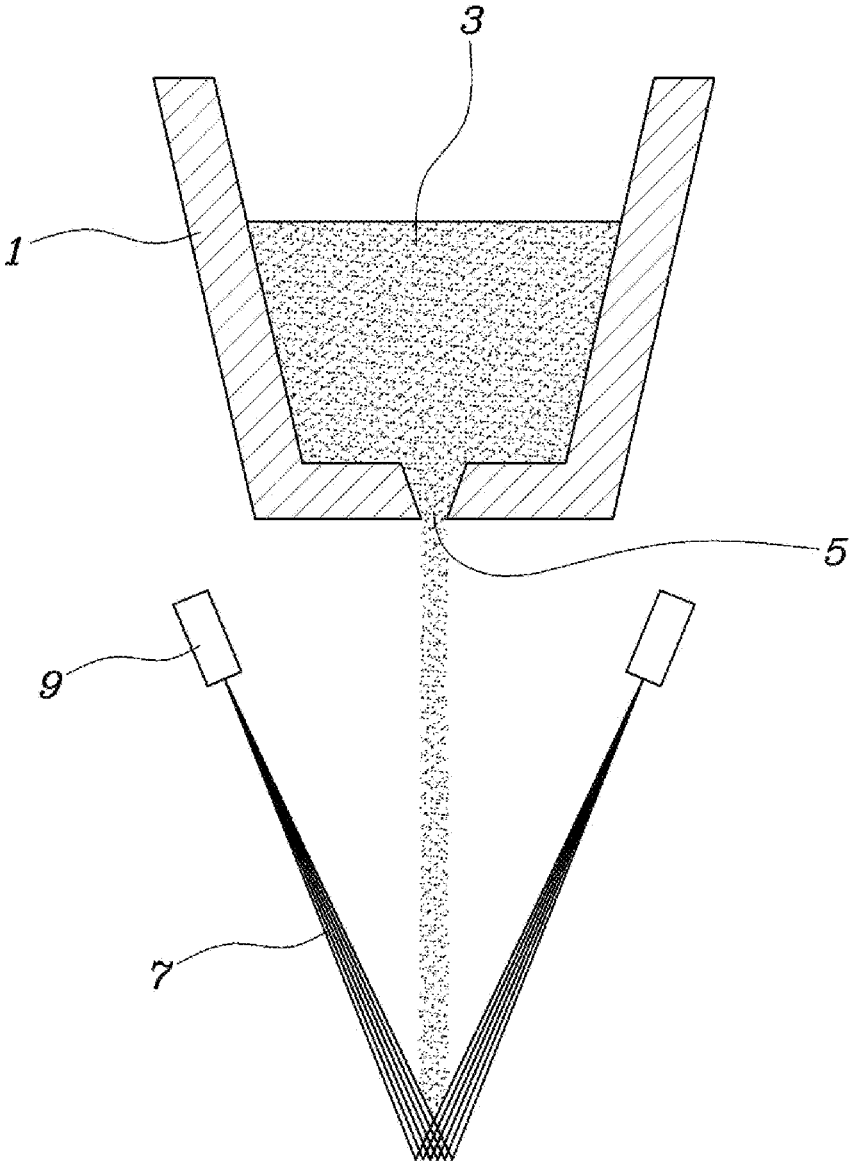
FIG. 1 (PRIOR ART)
FIG. 1 is a view for illustrating a conventional method of producing metal powder by a water atomization process.
Figure 2:
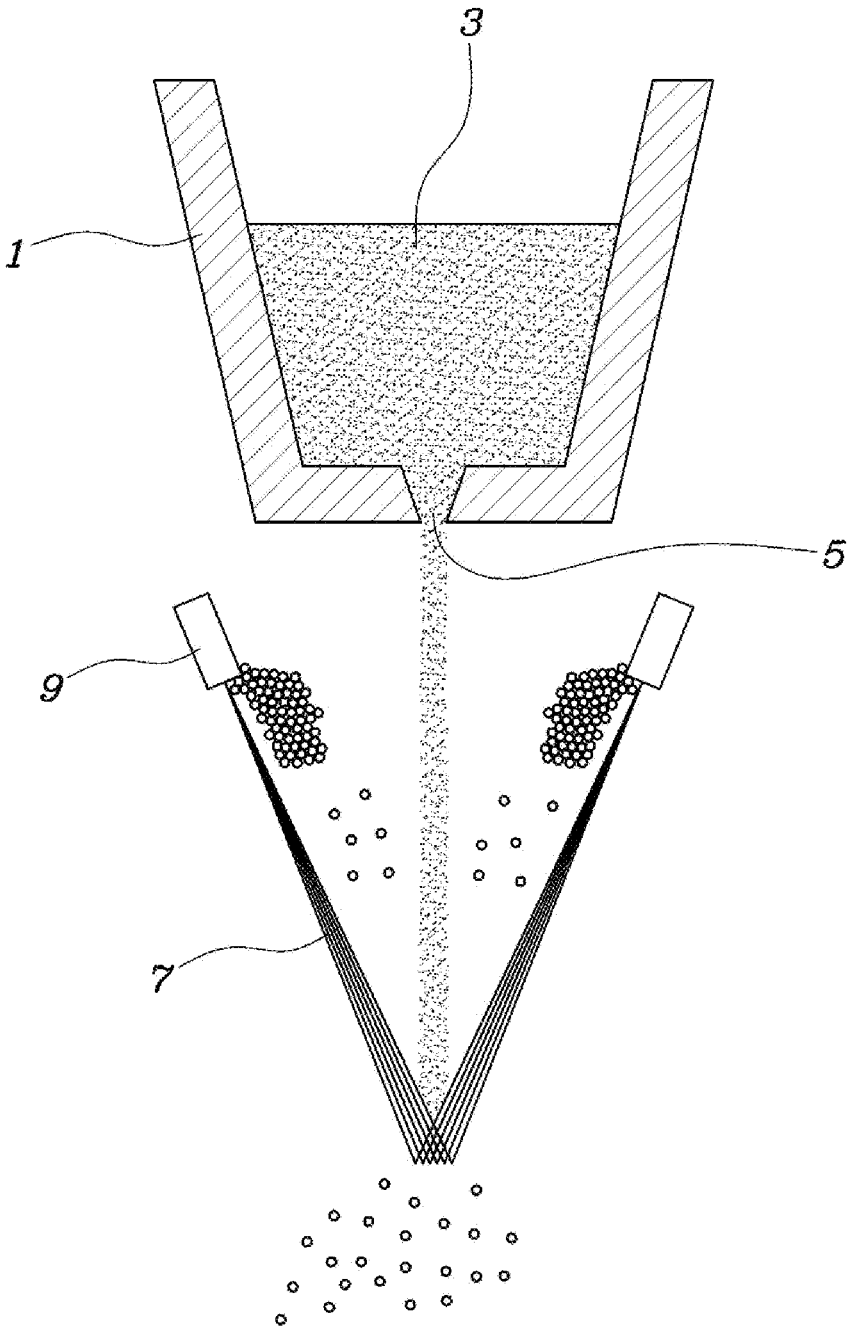
FIG. 2 (PRIOR ART)
FIG. 2 is a schematic view for illustrating that build-up of molten metal occurs due to a water splash phenomenon in the related art.
Figure 3:
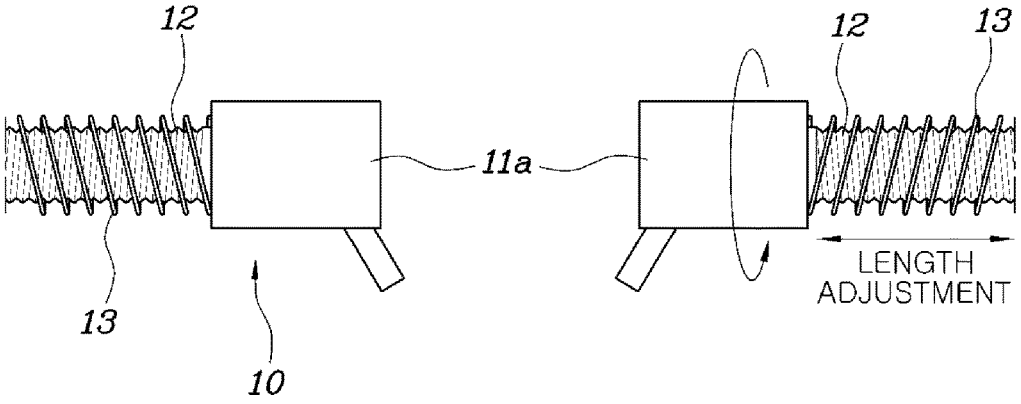
FIG. 3 is a view schematically illustrating nozzles according to various embodiments of the present invention.

FIG. 3 is a view schematically illustrating nozzles according to various embodiments of the present invention.

As illustrated in FIG. 3, each of nozzles 10 according to various embodiments of the present invention includes a fixed body 12 having a thread formed on the outer peripheral surface thereof while one side of the fixed body 12 is fixed to a lower portion of a tundish (e.g., tundish 1), a water atomization nozzle 11*a* having a thread which is formed on the inner peripheral surface thereof and engages with the thread formed on the outer peripheral surface of the fixed body 12, the water atomization nozzle 11*a* being coupled to the other side of the fixed body 12 and spraying water onto the flow of a molten metal 3, and a spring 13 installed around the outer peripheral surface of the fixed body 12 to provide an elastic force to the water atomization nozzle 11*a*.

In this case, the distance between the pair of water spraying nozzles 11*a* may be adjusted while the nozzles 11*a* rotate on the other sides of the respective fixed bodies 12.

Figure 4:
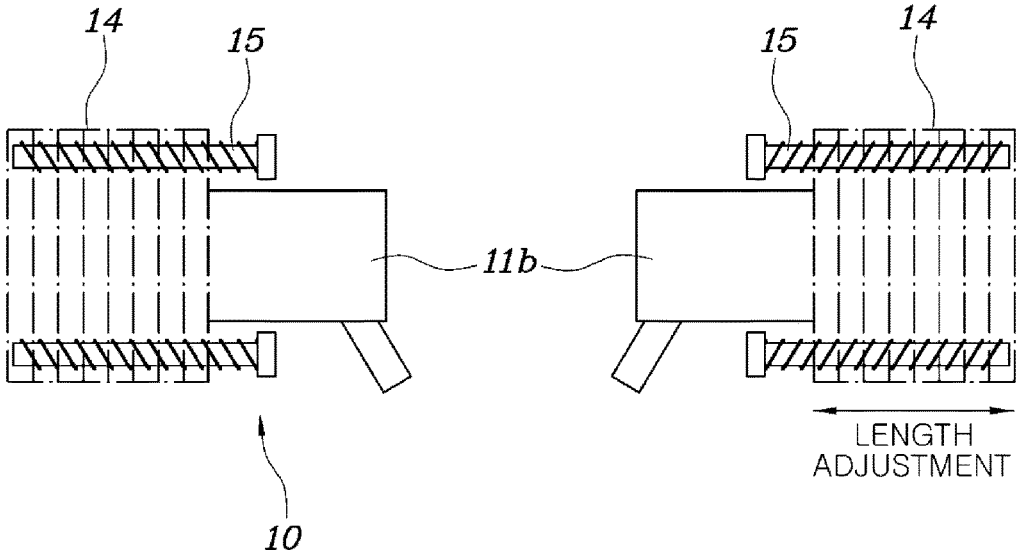
FIG. 4 is a view schematically illustrating nozzles according to various embodiments of the present invention.

FIG. 4 is a view schematically illustrating nozzles according to various embodiments of the present invention.

As illustrated in FIG. 4, each of nozzles 10 according to various embodiments of the present invention includes a spacer 14, one side of which is fixed to the lower portion of a tundish (e.g., tundish 1), having a variable length, a water spraying nozzle 11*b* installed to the other side of the spacer 14 to spray water onto the flow of a molten metal 3, and a length adjustment member 15 which adjusts the length of the spacer 14.

In some embodiments, the spacer 14 may have, for example, a spring structure having elasticity such that the length thereof varies. The length adjustment member 15 may be a bolt, and one side thereof is inserted into the spacer 14 to fix the length of the spacer 14, thereby enabling the distance between the water spraying nozzles 11*b* to be adjusted.

In various embodiments of the present invention, the atomization angle θ formed by the streams of water sprayed from the pair of water spraying nozzles 11 (11*a* or 11*b*) may be an angle of 45° to 50°, and the atomization pressure P of water is deduced and controlled by the following Equation (1). Description thereof will be given in detail with reference to a method of producing iron powder.

$$\frac{\log P}{\log P_0} = \frac{D}{D_0}, \qquad \text{[Equation (1)]}$$

where P: atomization pressure (bar), $P_0$: initial atomization pressure (bar), D: spraying distance (mm), and $D_0$: initial spraying distance (mm).

Hereinafter, a method of producing iron powder according to various embodiments of the present invention will be described with reference to the drawings.

Figure 5:
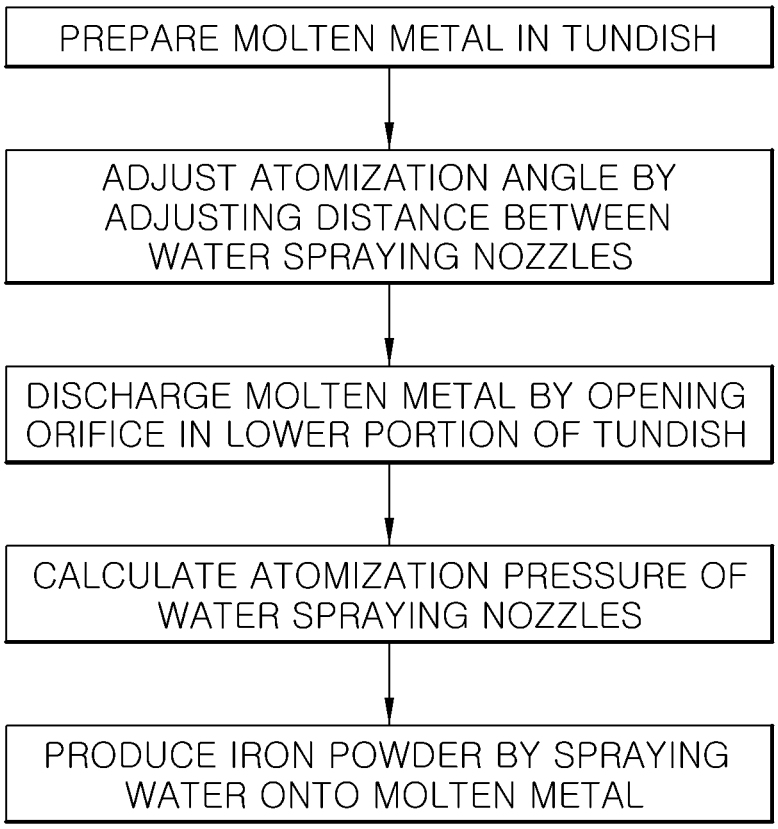
FIG. 5 is a flowchart illustrating a method of producing iron powder according to various embodiments of the present invention.

FIG. 5 is a flowchart illustrating a method of producing iron powder according to various embodiments of the present invention.

As illustrated in FIG. 5, the method of producing iron powder according to various embodiments of the present invention is a method of producing iron powder by a water atomization process, and includes a molten metal preparation process of preparing a molten metal 3 in a tundish 1, a molten metal discharge process of discharging the molten metal 3 in the downward direction of the tundish 1 for the free fall thereof, and a powder formation process of forming iron powder by spraying water onto the flow of the molten metal 3 falling free.

In the molten metal preparation process, scraps of iron are melted and stored in the tundish 1 having an orifice 5 formed on the bottom thereof.

When the molten metal preparation process is completed, the molten metal 3 accommodated in the tundish 1 falls free by opening the orifice 5 on the bottom of the tundish 1.

When the opening of the orifice 5 is completed, iron powder is produced in the powder formation process in which water 7 is sprayed onto the flow of the molten metal 3 falling free from the tundish 1 using a pair of water spraying nozzles 11 (11*a* or 11*b*), transforms the molten metal 3 into droplet form by colliding therewith, and then solidifies the same.

In this case, the atomization angle θ formed by the streams of water sprayed from the water spraying nozzles 11 may be an angle of 45° or more. The reason is because the recovery rate of iron powder is decreased when the atomization angle θ is an angle less than 45°.

In some embodiments, the method of producing iron powder according to various embodiments of the present invention may further include an atomization angle adjustment process of adjusting a distance between the water spraying nozzles 11 to adjust the atomization angle θ formed by the streams of water 7 colliding with the molten metal 3, prior to the molten metal discharge process.

In the atomization angle adjustment process, a point at which iron powder is formed by collision of the flow of the free-falling molten metal 3 with water 7 sprayed from each the water spraying nozzles 11 may be constant, namely a vertical distance between the water spraying nozzle 11 and the formation point of iron powder may be constant.

That is, in the atomization angle adjustment process, the atomization angle θ may be adjusted by increasing and decreasing the distance between the water spraying nozzles 11.

If only the atomization angle θ is adjusted in the state in which the positions of the water spraying nozzles 11 are fixed, the formation point of iron powder is adjacent to the water spraying nozzles 11. Hence, water splash or build-up of the molten metal 3 in the water spraying nozzles 11 occurs, which may lead to equipment damage and a decrease in recovery rate.

Accordingly, in the present invention, in order to prevent the recovery rate of iron powder from decreasing while preventing equipment damage and work accidents such as operation stop, the atomization angle θ is adjusted by increasing and decreasing the distance A between water spraying nozzles while the formation point of iron powder is constantly maintained.

This is because the acceleration of water α is increased even when the spraying distance of water D sprayed from each water spraying nozzle 11 becomes shorter, and thus the upward vertical vector value of the impact force of water is increased as indicated by the following Equation (2).

$$F_y = F\cos\left(\frac{\theta}{2}\right) = m\alpha\cos\left(\frac{\theta}{2}\right) = m\left(\frac{d^2D}{dt^2}\right)\cos\left(\frac{\theta}{2}\right), \qquad \text{[Equation (2)]}$$

where θ: atomization angle, α: acceleration of water, m: mass of water, D: spraying distance, and t: time.

Accordingly, in the method of producing iron powder according to various embodiments of the present invention, the atomization angle θ is adjusted by increasing and decreasing the distance A between water spraying nozzles while the formation point of iron powder is constantly maintained.

The following Equations (3) and (4) refer to a relationship of an atomization angle, a distance A between water spraying nozzles, and an injection distance D.

$$\sin\left(\frac{\theta}{2}\right) = \frac{A}{2D} \quad \text{[Equation (3)]}$$

$$4D^2 - A^2 = \text{constant} \quad \text{[Equation (4)]}$$

Figure 6:
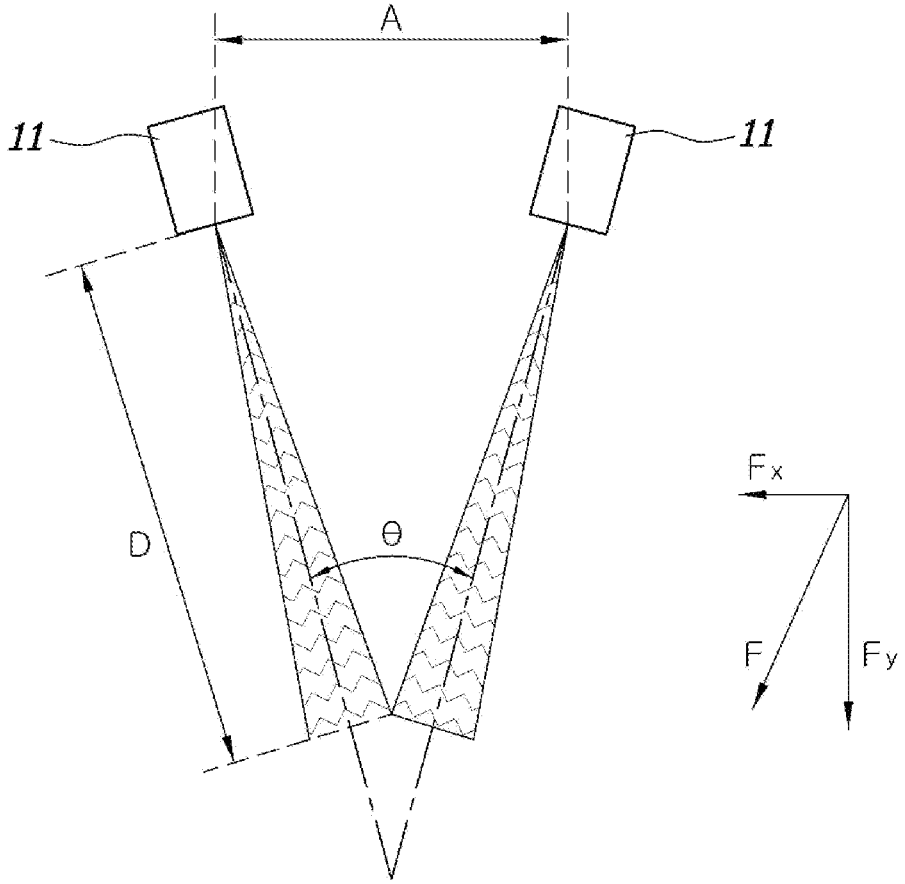
FIG. 6 is a view for illustrating a relationship of a distance between water spraying nozzles, a spraying distance of water, and an atomization angle formed by streams of water according to various embodiments of the present invention.

FIG. 6 is a view for explaining the relationship of the distance between water spraying nozzles, the spraying distance of water, and the atomization angle formed by streams of water.

As illustrated in FIG. 6, the atomization angle θ is an angle formed by a pair of water spraying nozzles, and is two times the angle formed by a stream of water sprayed from each water spraying nozzle 11 and an imaginary center line.

When the distance between the pair of water spraying nozzles 11, i.e. the distance A between water spraying nozzles, is increased in the state in which the atomization angle θ is fixed, the spraying distance D from each water spraying nozzle 11 to the point at which the water 7 sprayed therefrom collides with the molten metal 3 is increased compared to the initial distance. In this case, when the atomization pressure P of each water spraying nozzle 11 is constant, a sufficient pressure may not be maintained when the water 7 collides with the molten metal 3. Hence, efficiency in producing iron powder may be deteriorated or iron powder may not be formed.

In order for the atomization angle θ formed by the streams of water 7 to be an angle of 45 to 50° in the method of producing iron powder according to various embodiments of the present invention, after the distance A between water spraying nozzles is adjusted in the atomization angle adjustment process, each water spraying nozzle 11 is controlled by calculating the atomization pressure P of water sprayed from the water spraying nozzle 11, based on the distance A between water spraying nozzles and the spraying distance D.

In more detail, according to various embodiments of the present invention, the atomization pressure P of the water spraying nozzle 11 is deduced from the following Equation (1).

$$\frac{\log P}{\log P_0} = \frac{D}{D_0}, \quad \text{[Equation (1)]}$$

where P: atomization pressure (bar), $P_0$: initial atomization pressure (bar), D: spraying distance (mm), and $D_0$: initial spraying distance (mm).

That is, in order for the ratio between the atomization pressure P and the spraying distance D to be equal to the ratio between the initial atomization pressure $P_0$ and the initial spraying distance $D_0$ as reference values, the atomization pressure P of the water spraying nozzle 11 is controlled based on the spraying distance D of the water 7 increased as the distance between water spraying nozzles A is increased, and the atomization pressure P is set such that the spraying distance D is increased/decreased by increasing/decreasing the distance A between water spraying nozzles in order to increase the atomization angle θ. Consequently, it is possible to increase the recovery rate of iron powder while preventing water splash from occurring.

TABLE 1

| Sort | Distance between water spraying nozzles (A) | Atomization angle (θ) | Spraying distance (D) | Atomization pressure (P) | Recovery rate (%) |
|---|---|---|---|---|---|
| Comp. Ex. 1 | 94 mm | 38° | 144 | 94 bar | 80.5 |
| Comp. Ex. 2 | 94 mm | 45° | 113 | 100 bar | Nozzle clogging |
| Comp. Ex. 3 | 94 mm | 50° | 101 | 100 bar | Nozzle clogging |
| Example 1 | 100 mm | 40° | 146 | 100 bar | 84.1 |
| Example 2 | 113 mm | 45° | 148 | 107 bar | 88.3 |
| Example 3 | 128 mm | 50° | 151 | 117 bar | 94.5 |

As indicated by Table 1, in the comparative examples of the related art, it can be seen that, when the atomization angle θ is increased in the state in which the distance A between water spraying nozzles is fixed, work accidents, such as the clogging of the water spraying nozzles 11, occur as the spraying distance D becomes shorter. In addition, it can be seen that the recovery rate of iron powder is reduced to 80.5%.

On the other hand, according to various embodiments of the present invention, it can be seen that when the atomization angle θ is increased by increasing the distance A between water spraying nozzles, the spraying distance D and the atomization pressure P are increased together. Therefore, it is possible to reduce occurrence of water splash and simultaneously prevent work accidents such as the clogging of the water spraying nozzles 11 while the recovery rate is increased to maximum 94.5% by adjusting the atomization pressure.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for producing iron powder by a water atomization process, the apparatus comprising:

a pair of nozzles disposed in a lower portion of a tundish to face each other with a free-falling molten metal interposed therebetween, for spraying water onto the molten metal, wherein the nozzles are disposed such that a distance therebetween is adjustable, and wherein each of the nozzles comprises:

a fixed body including a thread formed on an outer peripheral surface of the fixed body, a first side of the fixed body being fixed to the lower portion of the tundish;

a water spraying nozzle including a thread formed on an inner peripheral surface of the water spraying nozzle, the thread engaging with the thread formed on the outer peripheral surface of the fixed body, the water spraying nozzle being disposed on a second side of the fixed body and spraying the water onto the molten metal discharged from the tundish to produce the iron powder; and a spring disposed around the outer peripheral surface of the fixed body to fix a position of the water spraying nozzle, the spring providing an elastic force to the water spraying nozzle.

2. The apparatus according to claim 1, wherein an atomization angle formed by streams of water sprayed from the pair of water spraying nozzles ranges from 45 to 50°.

* * * * *